United States Patent [19]

Warren et al.

[11] Patent Number: 5,052,920

[45] Date of Patent: Oct. 1, 1991

[54] GAS BURNER AND METHOD

[75] Inventors: John F. Warren, Flat Rock; Nelson G. Mayer, Rochester, both of Mich.

[73] Assignee: Lincoln Brass Works, Inc., Detroit, Mich.

[21] Appl. No.: 375,740

[22] Filed: Jul. 5, 1989

Related U.S. Application Data

[63] Continuation-in-part of Ser. No. 255,514, Oct. 11, 1988, abandoned.

[51] Int. Cl.[5] ..... F23D 14/62

[52] U.S. Cl. ..... 431/354; 29/509; 29/522.1; 239/600

[58] Field of Search ..... 431/191, 192, 354, 355; 29/890.02, 890.142, 509, 522.1, 523, 512; 239/600, 398, 427, 429, 430

[56] References Cited

U.S. PATENT DOCUMENTS

| | | | |
|---|---|---|---|
| 917,728 | 4/1909 | Hare | 239/130 |
| 1,028,666 | 6/1912 | Betts . | |
| 2,220,247 | 11/1940 | Kochendorfer et al. . | |
| 3,034,733 | 5/1962 | Brooks et al. . | |
| 3,289,731 | 12/1966 | Geber | 431/354 |
| 3,460,895 | 8/1969 | Yamaguchi | 431/354 |
| 3,506,198 | 4/1970 | Van Der Zwaal . | |
| 3,761,116 | 9/1973 | Scheitlin et al. | 29/523 X |
| 3,874,841 | 4/1975 | Ferlin . | |
| 3,922,138 | 11/1975 | Biddle et al. . | |
| 4,485,972 | 12/1984 | Freber . | |
| 4,690,636 | 9/1987 | Gonville et al. . | |
| 4,749,131 | 6/1988 | Katchka | 239/600 X |

FOREIGN PATENT DOCUMENTS

| | | | |
|---|---|---|---|
| 2301026 | 7/1974 | Fed. Rep. of Germany . | |
| 2241745 | 4/1975 | France | 431/354 |
| 436997 | 10/1935 | United Kingdom | 29/523 |
| 1003205 | 9/1965 | United Kingdom | 29/890.02 |
| 1397536 | 6/1975 | United Kingdom | 431/354 |
| 1579829 | 11/1980 | United Kingdom . | |

*Primary Examiner*—Carl D. Price

*Attorney, Agent, or Firm*—Harness, Dickey & Pierce

[57] ABSTRACT

A gas burner having a venturi tube located within the body of the burner, and an inexpensive method of manufacture.

14 Claims, 3 Drawing Sheets

GAS BURNER AND METHOD

CROSS REFERENCE TO RELATED APPLICATION

This application is a continuation-in-part application of U.S. Pat. application Ser. No. 255,514 filed on Oct. 11, 1988, abandoned.

BACKGROUND AND SUMMARY OF THE INVENTION

This invention relates to a gas burner, especially a range top gas burner, and to a method of manufacturing same. The gas burner of this invention has a high-burning efficiency but a low-manufacturing cost.

Some contemporary gas range designs have eliminated the top burner gas mixing tubes in order to produce a range with an uncluttered pleasant appearance when the main cook top is lifted up. Also, the elimination of the conventional gas mixing tubes allows reduction in the overall height of the underlying burner box. The disadvantage of this design is a reduction in the BTU/HR capacity of the burner, especially on propane fuel. Also, there is no way to provide an adjustable air shutter, which is desirable because of the various gas compositions in the field. The reduction of BTU/HR capacity results in slower heat up times.

It is therefore a primary object of this invention to provide a range top burner of significantly increased heating capacity for ranges designed without gas mixing tubes. A related object resides in the provision of such a burner which is of standard external configuration, is economical to manufacture, and may be all types used with of conventionally used gaseous fuels such as natural gas, propane and the like. It is a further object of the invention to provide a range top burner which produces significantly cleaner combustion products upon the burning of commonly used gaseous fuel, and to further provide a relatively economical method for the manufacture of such a gas burner.

DESCRIPTION OF THE PREFERRED EMBODIMENTS

Figure 1:
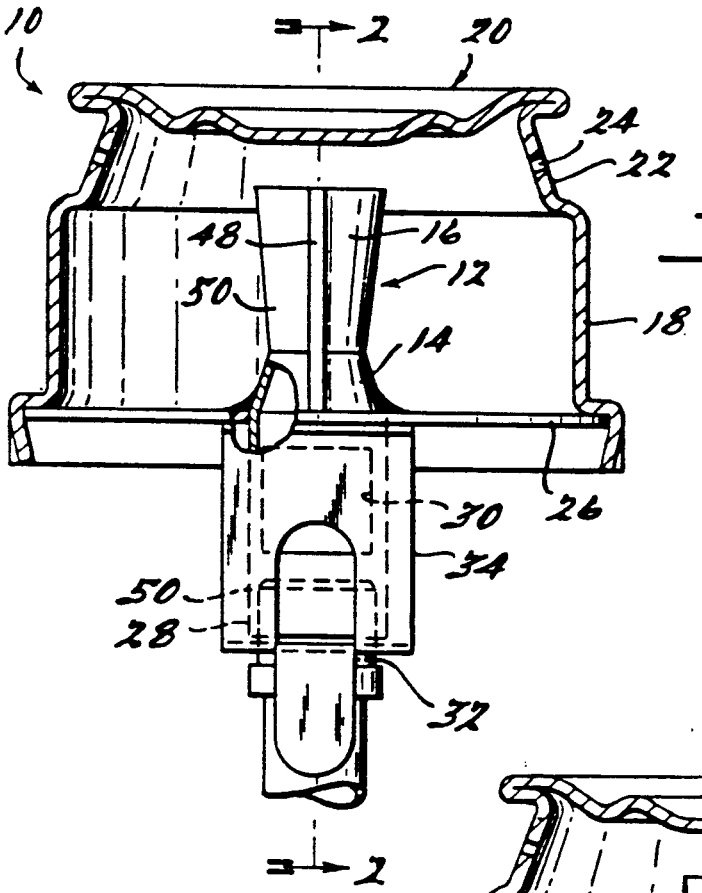
FIG. 1 is a vertical cross sectional view of a burner embodying the principles of the present invention.

The present invention achieves its objects by utilizing a small venturi actually disposed within the burner cap itself. With reference to FIG. 1, there is illustrated a gas burner 10 which includes an inverted cup-shaped body 18, preferably formed of sheet metal, having a top cap portion 20 and an annular sidewall 22 containing gas ports 24. Crimped to the bottom of body 18 is a base plate 26 having a central hole in which is disposed a tube 50, having at its upper end a venturi tube section 12 and at its lower end an inlet section 28 having air inlet openings 30. Venturi tube section 12 is formed by crimping tube 50, as at 48, thus creating a converging section 14 and a diverging section 16. Tube 50, in the embodiments of FIGS. 1-3, may be affixed to plate 26 by welding, brazing or soldering in order to form a gas-tight joint.

When mounted in the range, a conventional gas nozzle 32 extends into the end of tube section 28 in the usual manner. A bracket 34 connected to plate 26, by spot welding, brazing or the like, facilitates mounting the burner in the burner box assembly of the gas range. Gas nozzle 32 injects gaseous fuel from the usual gas line into tube section 28. The air openings 30 of tube section 28 allow air to mix with the injected gas. An air shutter may be provided for adjustment, if desired. This air and gas mixture travels through tube section 28 and venturi tube section 12, in an axial direction, into the interior of cap 18 from which it exits through ports 24 in the usual manner.

Figure 2:
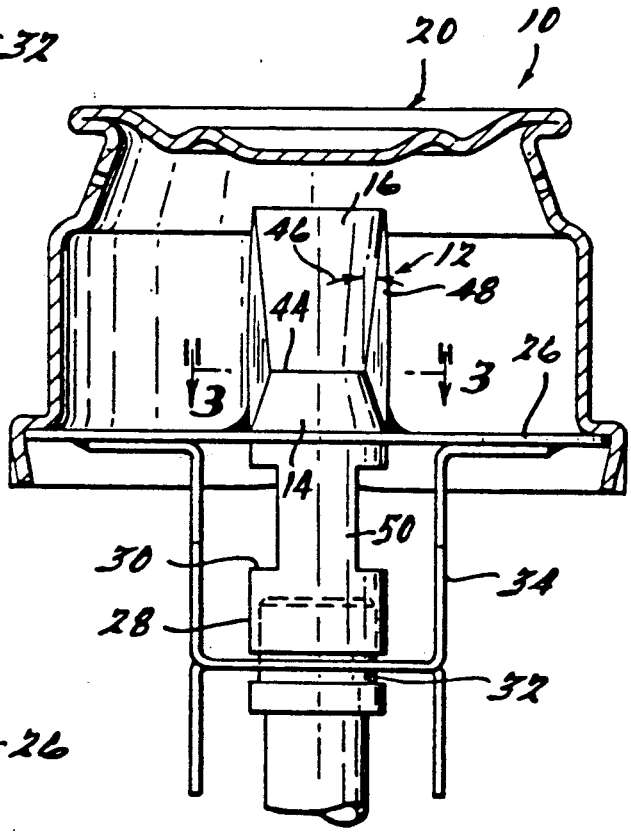
FIG. 2 is a vertical cross sectional view taken substantially along the line 2—2 of FIG. 1.
Figure 3:
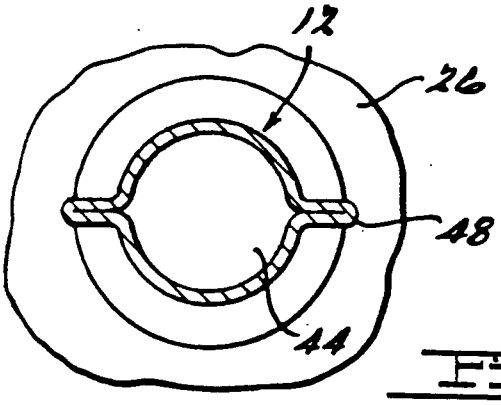
FIG. 3 is a horizontal cross sectional view taken substantially along the line 3—3 of FIG. 2.
Figure 5A:
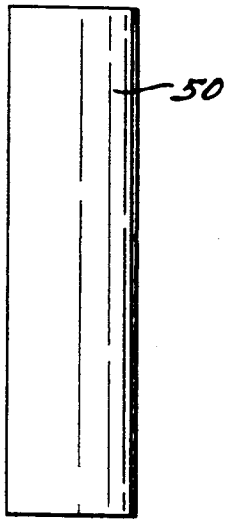
FIGS. 5(*a*)-(*e*) are side elevational views showing the steps of burner manufacture embodying the principles of this invention.
Figure 5B:
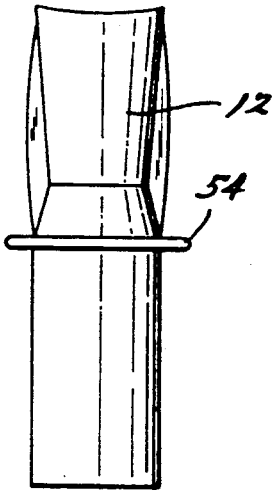
Figure 5C:
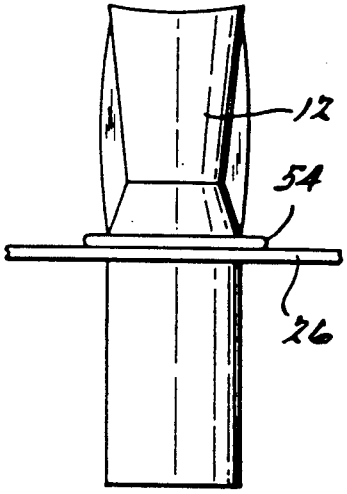
Figure 5D:
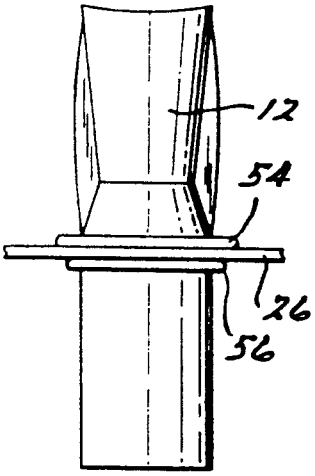
Figure 5E:
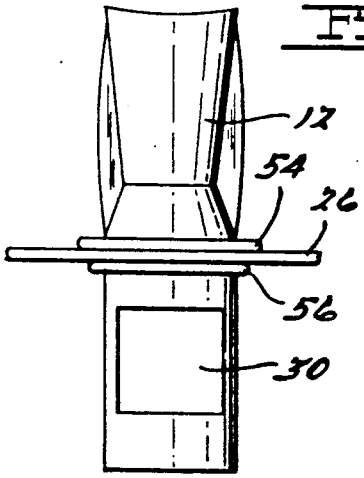

As shown best in FIGS. 2 and 3, the sections 14 and 16 of venturi tube section 12 define a throat 44 therebetween. Angle 46 represents the angle of the diverging portion of the venturi with respect to its center axis (or the vertical). It has be determined that this angle should be less than 8° in order to maximize the mixing of gas and air, thereby maximizing the efficiency and capacity of the burner. Capacity increases greater than 25% have been achieved with this embodiment of the present invention.

Figure 4:
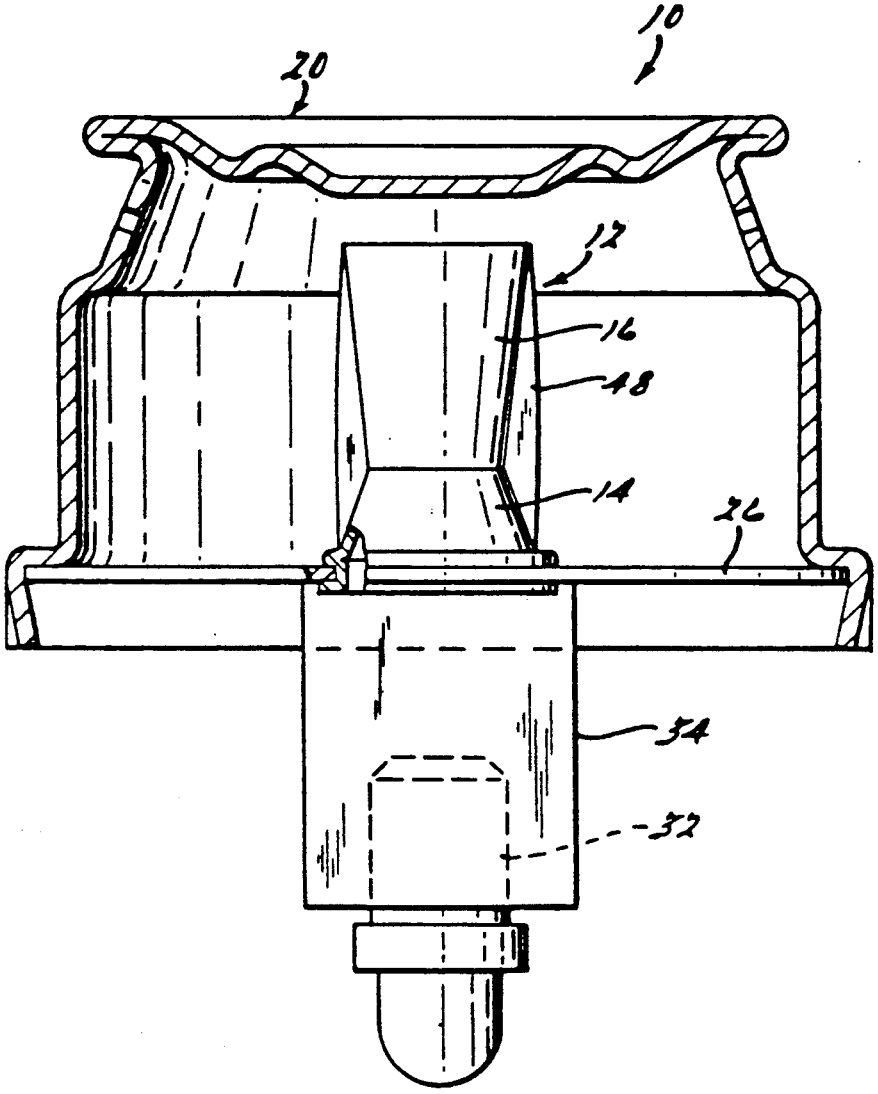
FIG. 4 is a view similar to FIG. 2 illustrating an alternative embodiment of the present invention.

The embodiment of FIG. 4 is substantially the same as the embodiment shown in FIG. 1, with the exception that tube section 28 below plate 26 is eliminated. Thus, gas nozzle 32 is positioned directly below the opening in plate 26, through which both air and gas flow into the venturi. The advantage of this embodiment is that the venturi can be attached to plate 26 by a simple gas-tight crimped connection comprising beads 47 and 49 which pinch plate 26 therebetween, thus reducing expense.

It has been found that the placement of such a venturi tube within a gas burner also provides a significant decrease in the carbon monoxide emissions from the gas burner. To verify the reduction of carbon monoxide in this manner, a plurality of experiments were conducted. The following examples illustrate the invention, but should not be construed to limit the same:

EXAMPLE I

Two gas ranges were set up such that the first range had top burners which utilized conventional burner mixing tubes. The second range had top burners designed in accordance with the teachings of this invention. The right front burner of the first and second gas ranges were selected for testing. These burners, on the first and second ranges, were adjusted such that they would deliver 8,937 BTU/HR. Natural gas fuel, at a pressure of 4" of water, was used in both burners. Both burners were adjusted for optimum air entrainment and had identical burner-to-grate distance relationships. Test utensils on both of the burner grates contained identical amounts of water and were at identical temperatures. The same procedure for collecting flue was used on both burners. Experimental results were as follows:

| Conventional Burner-Carbon Monoxide Emission | Burner Made in Accordance With This Invention-Carbon Monoxide Emission |
|---|---|
| 250 Parts Per Million | 200 Parts Per Million |

EXAMPLE II

Two gas ranges were set up such that the first range had top burners which utilized conventional burner mixing tubes. The second range had top burners designed in accordance with the teachings of this invention. The right front burner of the first and second gas ranges were selected for testing. These burners, on the first and second ranges, were adjusted such that they would deliver 8,962 BTU/HR. Propane gas fuel, at a pressure of 10" of water, was used in both burners. Both burners were adjusted for optimum air entrainment and has identical burner-to-grate distance relationships. Test utensils on both of the burner grates contained identical amounts of water and were at identical temperatures. The same procedure for collecting flue was used on both burners. Experimental results were as follows:

| Conventional Burner-Carbon Monoxide Emission | Burner Made in Accordance With This Invention-Carbon Monoxide Emission |
|---|---|
| 230 Parts Per Million | 90 Parts Per Million |

Figure 6:
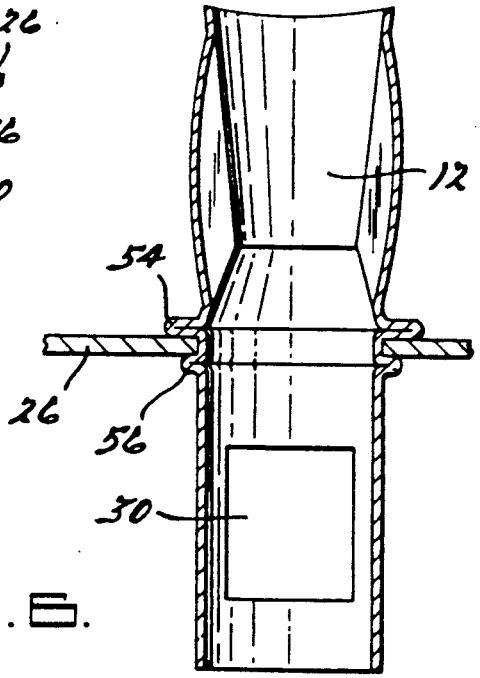
FIG. 6 is a vertical sectional view of a gas burner made in accordance with the method illustrated in FIGS. 5(*a*)-(*e*).

An improved method for economically manufacturing a gas burner of the embodiment of FIGS. 1–3, is shown in FIGS. 5(*a*)–(*e*). Initially a tube 50 is cut to the desired developed length, based on its application, as shown in FIG. 5(*a*). Any preferred conventional tube cutting machine may be used. Venturi section 12 and bead 54 can then be formed in a horizontal beading machine, with bead 54 being formed first, in the usual manner, and with venturi section 12 being thereafter formed using vertical cam vane dies. As shown in FIG. 5(*c*), the formed tube 5D is then inserted into a central hole in base plate 26. Tube 5D is then permanently affixed to base plate 26 by forming a second circumferential bead using a conventional bead and stake die. Beads 54 and 56 pinch base plate 26 tightly therebetween in order to effect the necessary seal. As shown in FIG. 5(*e*), opposed air inlet openings 30 are then formed simultaneously in tube 50 using two diametrically opposed shearing blades cooperating with an appropriate transversely apertured mandrel disposed within the tube, thereby completing the assembly. As shown in FIG. 6, mechanical beads 54 and 56 allow venturi tube 12 to be securely mounted within burner body 10 without the need for any sort of welding or brazing operations. These beads thus facilitate the manufacture of the preferred embodiment of this invention in a manner which is extremely cost effective, while still enabling an airtight seal to be formed between venturi tube 12 and base plate 26.

While it will be apparent that the preferred embodiments of the invention disclosed are well calculated to provide the advantages and features above stated, it will be appreciated that the invention is susceptible to modification, variation, and change without departing from the proper scope or fair meaning of the subjoined claims.

We claim:

1. A range top gas burner comprising:

an enclosed body defined by an inverted cup-shaped upper portion having gaseous fuel outlet ports and a generally horizontal plate closing the bottom of said upper portion, said plate being connected to said upper portion by a crimped connection around the periphery of said plate;

means defining a central opening in said plate through which inlet gaseous fuel is injected in a vertical axial direction along with combustion air;

axially disposed venturi means permanently affixed to said plate and disposed wholly within said body and communicating directly with said opening for enhancing the air/gas mixture being supplied to said ports; and a support member disposed below and affixed to said plate, said support member having a hole therethrough in vertical alignment with said opening, said hole being adapted to receive gaseous fuel only and being spaced from said plate to permit air to be drawn through said opening with said fuel.

2. The improvement of claim 1 wherein said venturi means is connected to said plate by a crimped connection around the periphery of said opening.

3. The improvement of claim 1 wherein said venturi means is brazed to said plate.

4. The improvement of claim 1 further comprising an inlet tube extending outwardly from said support plate.

5. The improvement of claim 4 wherein said inlet tube has an air inlet opening through the wall thereof.

6. The improvement of claim 5 wherein said venturi means and said inlet tube are integral with one another.

7. The improvement of claim 1 wherein said outlet ports direct gaseous fuel in a direction generally transverse to said axial direction.

8. The improvement of claim 1 wherein said body is formed of sheet metal.

9. The improvement of claim 1 wherein said venturi means is formed of sheet metal.

10. The improvement of claim 1 wherein the included angle of the outlet portion of said venturi is less than approximately 16°.

11. A method for manufacturing a gas burner having a base plate which contains an opening, said method comprising:

(a) cutting a hollow tube to length;

(b) crimping said tube to form a venturi portion in said tube adjacent one end thereof;

(c) forming a bead on said tube between said venturi portion and an opposite end of such tube;

(d) inserting said tube through said opening of said base plate so that said bead engages one face of said base plate and said venturi portion is deposed in said burner, the opposite end of said tube extending outside said plate; and (e) permanently affixing said tube to said base plate.

12. The method of claim 11 wherein said tube is affixed to said base plate by forming a second mechanical bead on said tube on the opposite face of said base plate.

13. The method of claim 11 wherein said method further comprises the step of forming an air inlet opening through the wall of said tube on the opposite side of said base plate than said venturi portion.

14. The method of claim 12 wherein said gas burner also includes a burner cap, said method further comprising crimping said burner cap to said base plate.

* * * * *

UNITED STATES PATENT AND TRADEMARK OFFICE

CERTIFICATE OF CORRECTION

PATENT NO. : 5,052,920

DATED : October 1, 1991

INVENTOR(S) : John F. Warren and Nelson G. Mayer

It is certified that error appears in the above-identified patent and that said Letters Patent is hereby corrected as shown below:

Column 1, line 33, after "be" insert -- used with --.

Column 1, line 34, after "types" delete "used with".

Column 2, line 27, "be" should be -- been --.

Column 3, line 20, "has" should be -- had --.

Signed and Sealed this

Twenty-first Day of June, 1994

*Attest:*

Bruce Lehman

BRUCE LEHMAN

*Attesting Officer*

*Commissioner of Patents and Trademarks*